US010708685B2

(12) United States Patent
Hijman et al.

(10) Patent No.: US 10,708,685 B2
(45) Date of Patent: Jul. 7, 2020

(54) RECEIVER WITH VENTING OPENING

(71) Applicant: Sonion Nederland B.V., Hoofddorp (NL)

(72) Inventors: Jan Hijman, Hoofddorp (NL); Gerardus Johannes Franciscus Theodorus van der Beek, Hoofddorp (NL); Camiel Eugène Groffen, Hoofddorp (NL); Tomasz Kaszuba, Hoofddorp (NL); Krzysztof Bialy, Hoofddorp (NL); Grzegorz Kurpiel, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 15/989,969

(22) Filed: May 25, 2018

(65) Prior Publication Data

US 2018/0343515 A1 Nov. 29, 2018

(30) Foreign Application Priority Data

May 26, 2017 (EP) ..... 17173062

(51) Int. Cl.

| | |
|---|---|
| ***H04R 1/28*** | (2006.01) |
| ***H04R 11/02*** | (2006.01) |
| ***H04R 7/06*** | (2006.01) |
| ***H04R 1/02*** | (2006.01) |

(52) U.S. Cl.

CPC ..... *H04R 1/2826* (2013.01); *H04R 1/025* (2013.01); *H04R 7/06* (2013.01); *H04R 11/02* (2013.01); *H04R 1/2807* (2013.01); *H04R 2207/00* (2013.01); *H04R 2307/027* (2013.01); *H04R 2400/11* (2013.01)

(58) Field of Classification Search

CPC ..... H04R 1/2826; H04R 1/02; H04R 7/06; H04R 11/02; H04R 1/2807; H04R 2207/027; H04R 2307/027; H04R 2400/11

See application file for complete search history.

(56) References Cited

U.S. PATENT DOCUMENTS

| | | | | |
|---|---|---|---|---|
| 5,222,050 | A * | 6/1993 | Marren | H04R 1/44 181/132 |
| 6,788,796 | B1 | 9/2004 | Miles | |
| 6,831,577 | B1 | 12/2004 | Furst | |
| 6,853,290 | B2 | 2/2005 | Jorgensen | |
| 6,859,542 | B2 | 2/2005 | Johannsen | |
| 6,888,408 | B2 | 5/2005 | Furst | |
| 6,914,992 | B1 | 7/2005 | van Halteren | |

(Continued)

FOREIGN PATENT DOCUMENTS

DE 102007014365 A1 10/2008

OTHER PUBLICATIONS

Extended European Search Report in European Patent Application No. EP 17173062, dated Oct. 31, 2017 (2 pages).

*Primary Examiner* — Sunita Joshi
(74) *Attorney, Agent, or Firm* — Nixon Peabody LLP

(57) ABSTRACT

The present invention relates to a receiver assembly comprising a membrane structure comprising a frame portion and a moveable diaphragm, an assembly housing, and an acoustical venting opening connecting an interior volume of the receiver assembly to an exterior volume outside assembly housing, the acoustical venting opening forming an acoustical passage at least through the membrane structure.

17 Claims, 7 Drawing Sheets

(56) References Cited

U.S. PATENT DOCUMENTS

| | | | |
|---|---|---|---|
| 6,919,519 | B2 | 7/2005 | Ravnkilde |
| 6,930,259 | B1 | 8/2005 | Jorgensen |
| 6,943,308 | B2 | 9/2005 | Ravnkilde |
| 6,974,921 | B2 | 12/2005 | Jorgensen |
| 7,008,271 | B2 | 3/2006 | Jorgensen |
| 7,012,200 | B2 | 3/2006 | Moller |
| 7,062,058 | B2 | 6/2006 | Steeman |
| 7,062,063 | B2 | 6/2006 | Hansen |
| 7,072,482 | B2 | 7/2006 | Van Doorn |
| 7,088,839 | B2 | 8/2006 | Geschiere |
| 7,110,560 | B2 | 9/2006 | Stenberg |
| 7,136,496 | B2 | 11/2006 | van Halteren |
| 7,142,682 | B2 | 11/2006 | Mullenbom |
| 7,181,035 | B2 | 2/2007 | van Halteren |
| 7,190,803 | B2 | 3/2007 | van Halteren |
| 7,206,428 | B2 | 4/2007 | Geschiere |
| 7,221,767 | B2 | 5/2007 | Mullenbom |
| 7,221,769 | B1 | 5/2007 | Jorgensen |
| 7,227,968 | B2 | 6/2007 | van Halteren |
| 7,239,714 | B2 | 7/2007 | de Blok |
| 7,245,734 | B2 | 7/2007 | Niederdraenk |
| 7,254,248 | B2 | 8/2007 | Johannsen |
| 7,286,680 | B2 | 10/2007 | Steeman |
| 7,292,700 | B1 | 11/2007 | Engbert |
| 7,292,876 | B2 | 11/2007 | Bosh |
| 7,336,794 | B2 | 2/2008 | Furst |
| 7,376,240 | B2 | 5/2008 | Hansen |
| 7,403,630 | B2 | 7/2008 | Jorgensen |
| 7,415,121 | B2 | 8/2008 | Mögelin |
| 7,425,196 | B2 | 9/2008 | Jorgensen |
| 7,460,681 | B2 | 12/2008 | Geschiere |
| 7,466,835 | B2 | 12/2008 | Stenberg |
| 7,492,919 | B2 | 2/2009 | Engbert |
| 7,548,626 | B2 | 6/2009 | Stenberg |
| 7,657,048 | B2 | 2/2010 | van Halteren |
| 7,684,575 | B2 | 3/2010 | van Halteren |
| 7,706,561 | B2 | 4/2010 | Wilmink |
| 7,715,583 | B2 | 5/2010 | Van Halteren |
| 7,728,237 | B2 | 6/2010 | Pedersen |
| 7,809,151 | B2 | 10/2010 | Van Halteren |
| 7,822,218 | B2 | 10/2010 | Van Halteren |
| 7,899,203 | B2 | 3/2011 | Van Halteren |
| 7,912,240 | B2 | 3/2011 | Madaffari |
| 7,946,890 | B1 | 5/2011 | Bondo |
| 7,953,241 | B2 | 5/2011 | Jorgensen |
| 7,961,899 | B2 | 6/2011 | Van Halteren |
| 7,970,161 | B2 | 6/2011 | van Halteren |
| 8,098,854 | B2 | 1/2012 | van Halteren |
| 8,101,876 | B2 | 1/2012 | Andreasen |
| 8,103,039 | B2 | 1/2012 | van Halteren |
| 8,160,290 | B2 | 4/2012 | Jorgensen |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman |
| 8,233,652 | B2 | 7/2012 | Jorgensen |
| 8,259,963 | B2 | 9/2012 | Stenberg |
| 8,259,976 | B2 | 9/2012 | van Halteren |
| 8,259,977 | B2 | 9/2012 | Jorgensen |
| 8,280,082 | B2 | 10/2012 | van Halteren |
| 8,284,966 | B2 | 10/2012 | Wilk |
| 8,313,336 | B2 | 11/2012 | Bondo |
| 8,315,422 | B2 | 11/2012 | van Halteren |
| 8,331,595 | B2 | 12/2012 | van Halteren |
| 8,369,552 | B2 | 2/2013 | Engbert |
| 8,379,899 | B2 | 2/2013 | van Halteren |
| 8,509,468 | B2 | 8/2013 | van Halteren |
| 8,526,651 | B2 | 9/2013 | Lafort |
| 8,526,652 | B2 | 9/2013 | Ambrose |
| 2002/0136425 | A1* | 9/2002 | Warren ..... H04R 11/02 381/423 |
| 2004/0071303 | A1* | 4/2004 | Furuya ..... H04M 1/035 381/182 |
| 2011/0182453 | A1 | 7/2011 | van Hal |
| 2011/0189880 | A1 | 8/2011 | Bondo |
| 2011/0299708 | A1 | 12/2011 | Bondo |
| 2011/0299712 | A1 | 12/2011 | Bondo |
| 2011/0311069 | A1 | 12/2011 | Ambrose |
| 2012/0014548 | A1 | 1/2012 | van Halteren |
| 2012/0027245 | A1 | 2/2012 | van Halteren |
| 2012/0140966 | A1 | 6/2012 | Mocking |
| 2012/0155683 | A1 | 6/2012 | van Halteren |
| 2012/0155694 | A1 | 6/2012 | Reeuwijk |
| 2012/0255805 | A1 | 10/2012 | van Halteren |
| 2013/0028451 | A1 | 1/2013 | de Roo |
| 2013/0136284 | A1 | 5/2013 | van Hal |
| 2013/0142370 | A1 | 6/2013 | Engbert |
| 2013/0163799 | A1 | 6/2013 | Van Halteren |
| 2013/0195295 | A1 | 8/2013 | van Halteren |
| 2014/0161290 | A1 | 6/2014 | Jenkins |
| 2015/0207392 | A1* | 7/2015 | Iwakura ..... H02K 33/00 310/25 |
| 2016/0255433 | A1* | 9/2016 | Grinker ..... H04R 1/1016 381/380 |

* cited by examiner

RECEIVER WITH VENTING OPENING

CROSS REFERENCE TO RELATED APPLICATIONS

This application claims the benefit of European Patent Application Serial No. EP 17173062.5, filed May 26, 2017, and titled "Receiver With Venting Opening," which is incorporated herein by reference in its entirety.

FIELD OF THE INVENTION

The present invention relates to a receiver having a venting opening for boosting the low-frequency response of a receiver. In particular, the present invention relates to a receiver having an easy implementable venting opening between a back volume and the exterior of the receiver.

BACKGROUND OF THE INVENTION

It is well established knowledge that the low-frequency response of a receiver can be boosted by providing a venting opening between the back volume of the receiver and the exterior of the receiver. By providing a properly dimensioned venting opening the back volume of the receiver may be vented via an orifice/acoustical impedance in a manner so that the back volume is fully vented at low frequencies (from around 5 Hz to around 1 kHz), i.e. the vented/open back volume configuration is favorable for low frequency reproduction. As the frequency increases the acoustical impedance also increases causing the back volume to be seen as a closed back volume at higher frequencies leaving a first resonance peak at the same frequency as the more favorable closed back volume configuration for high frequency reproduction. By carefully choosing the acoustical impedance as function of frequency the transfer/response curve of the receiver can be tailored to comply with specific demands.

Traditionally, venting openings are provided through a housing part of the receiver via a tube, a mesh or a damping cloth in order to provide a desired acoustical impedance. However, the traditional techniques for providing a venting opening are disadvantageous seen from a cost perspective as additional process steps and/or additional materials are often required. In addition, the risk of manufacturing defects or failures is affected by the additional process steps. Therefore, there is a need for providing venting openings in a more cost effective and easy manner.

It may be seen as an object of embodiments of the present invention to provide an advantageous arrangement in terms of manufacturing and costs for implementing a venting opening in a receiver in order to boost the low-frequency response of the receiver.

DESCRIPTION OF THE INVENTION

The above-mentioned object is complied with by providing a receiver assembly comprising a. a membrane structure comprising a frame portion and a moveable diaphragm,
b. an assembly housing, and
c. an acoustical venting opening connecting an interior volume of the receiver assembly to an exterior volume outside assembly housing, said acoustical venting opening forming an acoustical passage at least through the membrane structure.

Thus, according to the first aspect the present invention relates to a sound generating receiver assembly comprising a venting opening through the membrane structure in order to boost the low-frequency response of the receiver assembly.

The membrane structure comprises a frame portion and a moveable diaphragm. The frame portion of the membrane structure may be an essential static portion that is rigidly connected to the assembly housing. According to the first aspect the acoustical venting opening may be positioned in the frame portion of the membrane structure.

The moveable diaphragm may be hinged to the frame portion and thus being moveable in relation thereto. The frame portion and moveable diaphragm of the membrane structure may form an integrated structure being made of the same material. Moreover, one or more openings may exist between the frame portion and the moveable diaphragm so that the latter is allowed to move relative to the frame portion. Alternatively, the frame portion and the moveable diaphragm may be discrete components being made of either the same or different materials. The moveable diaphragm may for example be made of a metal, such as nickel, steel, iron, aluminum, magnesium, or aluminum/magnesium alloys, such as AlMg3, or plastic material, such as a polymer, or any other material which is suitable for converting mechanical movements to acoustic pressure variations. The thickness of the membrane structure may be larger than 10 μm, such as larger than 20 μm, such as larger than 30 μm, such as larger than 40 μm.

A foil layer may be secured to the membrane structure in order to form one or more seal members across one or more openings between the frame portion and the moveable diaphragm. The foil layer may in principle be made of any formable and flexible material which is compliant enough to not hinder the diaphragm movements significantly. Examples of foil layer materials may be polymer layers including for example polyethylene terephthalate (PET) or polyurethane (PU). The thickness of the foil layer may be smaller than 40 μm, such as smaller than 30 μm, such as smaller than 20 μm, such as smaller than 10 μm, such as smaller than 8 μm, such as smaller than 6 μm, such as smaller than 4 μm.

It is advantageous that the existing foil layer may also be used to form an acoustical venting opening which may be aligned with the acoustical venting opening in the membrane structure. The acoustical venting opening in the foil layer may advantageously be made using laser before or after assembling the receiver. Moreover, as a laser is a high-precision tool the opening in the foil layer may be made with high accuracy. Even further the manufacture is in principle free to choose an opening size with enough precision to tune the venting of the receiver to specific demands, i.e. to a specific response curve.

The dimensions of the acoustical venting opening in the foil layer may be smaller than the dimensions of the acoustical venting opening in the membrane structure whereby the acoustical properties of the venting opening may be given by the dimensions of the acoustical venting opening in the foil layer.

The acoustical venting opening connecting an interior volume of the receiver assembly to an exterior volume outside assembly housing may comprise a tube forming the acoustical passage through the membrane structure. The tube may be secured to the membrane structure using an appropriate sealing material.

In order to generate sound the moveable diaphragm should be moved in accordance with an applied drive signal. Thus, the receiver assembly may further comprise a drive unit for driving the moveable diaphragm of the membrane structure in response to an applied drive signal. The drive unit may in principle be any kind of drive unit, such as a moving armature type drive unit. The moving armature type drive unit may comprise a U-shaped armature comprising an integrated drive pin. Alternatively, the drive pin may be discrete component being inserted between the U-shaped armature and the moveable diaphragm.

The assembly housing may comprise a can part and a cover part. At least part of the frame portion of the membrane structure may advantageously form a seal between the can part and the cover part.

At least one of the can part and the cover part may comprise at least one opening to allow one or more wires to extend from the interior volume of the receiver assembly to an exterior volume outside the receiver assembly. In one embodiment, at least one of the can part and the cover part may additionally or alternatively comprise at least one depression/recess formed at an edge portion to form an opening. The depression(s)/recess(es) may be formed by exerting a pressure at the edge portion at the required position. Alternatively, the depression(s)/recess(es) may be formed as part of a moulding process when manufacturing at least one of the first and second housing parts. The depression(s)/recess(es) leave(s) space for wires, such as wires for providing drive signals to the drive unit.

The cover part may comprise a sound outlet opening and an acoustical venting opening forming an acoustical passage through the cover part, said acoustical venting opening being aligned with the acoustical venting opening of the membrane structure. The venting opening of the cover part may also be aligned with a venting opening in a foil layer.

The acoustical venting opening of the receiver assembly may acoustically connect a back volume of the receiver assembly to the exterior outside assembly housing.

In a second aspect the present invention relates to a receiver assembly comprising a. a membrane structure comprising a frame portion and a moveable diaphragm,
b. an assembly housing, and
c. an acoustical venting opening connecting an interior volume of the receiver assembly to an exterior volume outside assembly housing, said acoustical venting opening comprising a passage through a foil layer.

Thus, according to the second aspect the acoustical venting opening is provided through a foil layer. This is advantageous in that the opening in the foil layer may be made using a laser either before or after assembling the receiver. Moreover, as a laser is a high-precision tool the opening in the foil layer may be made with high accuracy.

The membrane structure may be implemented as disclosed in connection with the first aspect. The foil layer comprising the acoustical venting opening may form part of a foil layer secured to the membrane structure, said foil layer also forming one or more seal members across one or more openings between the frame portion and the moveable diaphragm. The assembly housing may comprise a can part and a cover part, and the acoustical venting opening may go through the cover part.

In an alternative implementation the foil layer comprising the acoustical venting opening may be a separate piece of foil layer which is separated from a foil layer being secured to membrane structure. Also in this alternative implementation the assembly housing may comprise a can part and a cover part, wherein at least part of the frame portion of the membrane structure forms a seal between the can part and the cover part. The separate piece of foil layer may be secured to the can part so that the acoustical venting opening may go through the can part.

The properties of the foil layer may be similar to those addressed in connection with the first aspect. Also, the drive unit addressed in connection with the first aspect may be applied in connection with the receiver assembly according to the second aspect.

In a third aspect the present invention relates to a receiver assembly comprising:

a. a receiver housing comprising a can part and a cover part, the receiver housing defining an inner space, wherein the can part and the cover part are movable relative to each other to define an open configuration and a closed configuration,
b. an armature extending in a first direction in the inner space,
c. a moveable diaphragm operationally attached to the armature via a drive pin extending in a second direction, wherein the drive pin and the armature are formed in one part.

Thus, according to the third aspect of the present invention the drive pin and the armature may be formed in one part; i.e. as an integral unit. In the context of the present invention, the term "formed in one part" should be understood as an element which is formed without a joint. Thus, the drive pin and the armature are not formed as two separate elements being subsequently assembled.

Traditionally, assembling of receiver assemblies require multiple step including positioning of the drive pin relative to the armature and the moveable diaphragm. This can deform the armature and/or the drive pin. Furthermore, gluing of the drive pin to the armature requires a curing step. During this curing step the drive pin may move.

By providing the drive pin and the armature as an integral units formed in one part or piece, assembling of receiver assemblies may result in a lower reject rate, as some of the traditional process steps, such as gluing and curing may be omitted.

Furthermore, a separate drive pin which is joined with an armature is traditionally made from beryllium copper e.g. by clamp fitting and subsequently sealing e.g. by use of an adhesive. By forming the drive pin and the armature as an integral unit in one part, the use of beryllium copper can be avoided whereby the risk of inhalation of dust containing beryllium which can cause serious lung decease may be avoided.

The drive pin and the armature may comprise a bent transition portion, where the armature may extend in the first direction from the transition portion and the drive pin may extend in the second direction from the transition portion. The bent transition portion may as an example be formed by moulding or by bending of the integral unit forming the armature and the drive pin.

The angle between the first direction and the second direction may be in the range of 60 to 120 degrees, such as in the range of 70 to 110 degrees, such as in the range of 80 to 100 degrees.

BRIEF DESCRIPTION OF THE DRAWINGS

The present invention will now be described in further details with reference to the accompanying figures.

Figure 1:
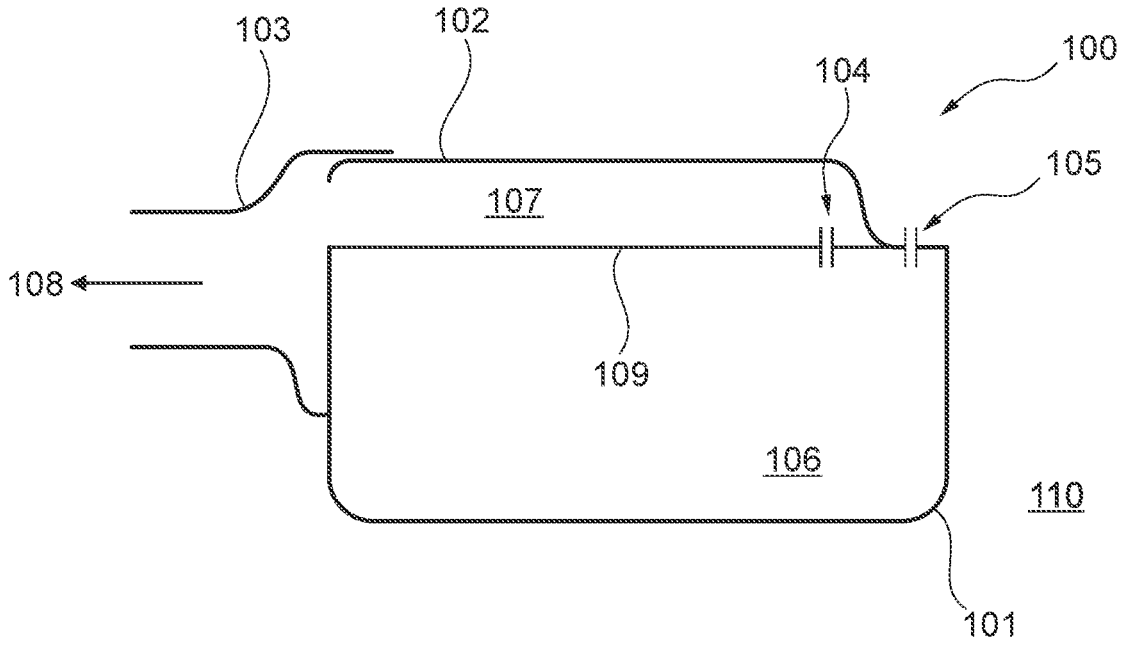
FIG. 1 shows a schematic of a first entire receiver.

While the invention is susceptible to various modifications and alternative forms specific embodiments have been shown by way of examples in the drawings and will be described in details herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In its broadest aspect the present invention relates to a receiver having a venting opening between a back volume of the receiver and the exterior of the receiver, i.e. outside world. The venting opening may be provided through the membrane of the receiver, through a cover part of a receiver housing and/or through a can part of a receiver housing. The venting opening is provided for boosting the low-frequency response of the receiver.

Referring now to FIG. 1 a cross-sectional schematic of a receiver 100 according to the present invention is depicted. As seen in FIG. 1 the receiver 100 comprises a receiver housing comprising a can part 101, a cover part 102 and a spout 103 through which spout 103 the generated sound 108 will leave the receiver 100. The receiver 100 further comprises a membrane structure 109 having frame portion and a moveable diaphragm (not shown). The membrane structure may be an integrated component where the frame portion and the moveable diaphragm are made of the same material. Alternatively, the frame portion and the moveable diaphragm may be discrete components being assembled to form the membrane structure. The moveable diaphragm may for example be made of nickel, steel, iron, aluminum magnesium etc.

The frame portion is rigidly connected to the receiver housing whereas the moveable diaphragm is hinged to the frame portion in a manner that allows it to move in relation thereto. A foil layer (not shown) is secured to the membrane structure with the aim of providing one or more seal members across one or more openings between the frame portion and the moveable diaphragm.

The interior of the receiver 100 defines a front volume 107 and a back volume 106 being acoustically connected via a compensation opening 104. Moreover, the back volume 106 is acoustically connected to the exterior 110 of the receiver 100 via a venting opening 105 in the membrane structure 109. A proper tuning of the venting opening 105 using for example a laser will boost the low-frequency response of the receiver. In a preferred embodiment the foil layer secured to the membrane structure, cf. for example FIGS. 2 and 3, will be used for fine tuning the dimensions of the venting opening 105. The opening in the foil layer may advantageously be provided using a laser in order to ensure proper tuning of the opening.

Figure 7:
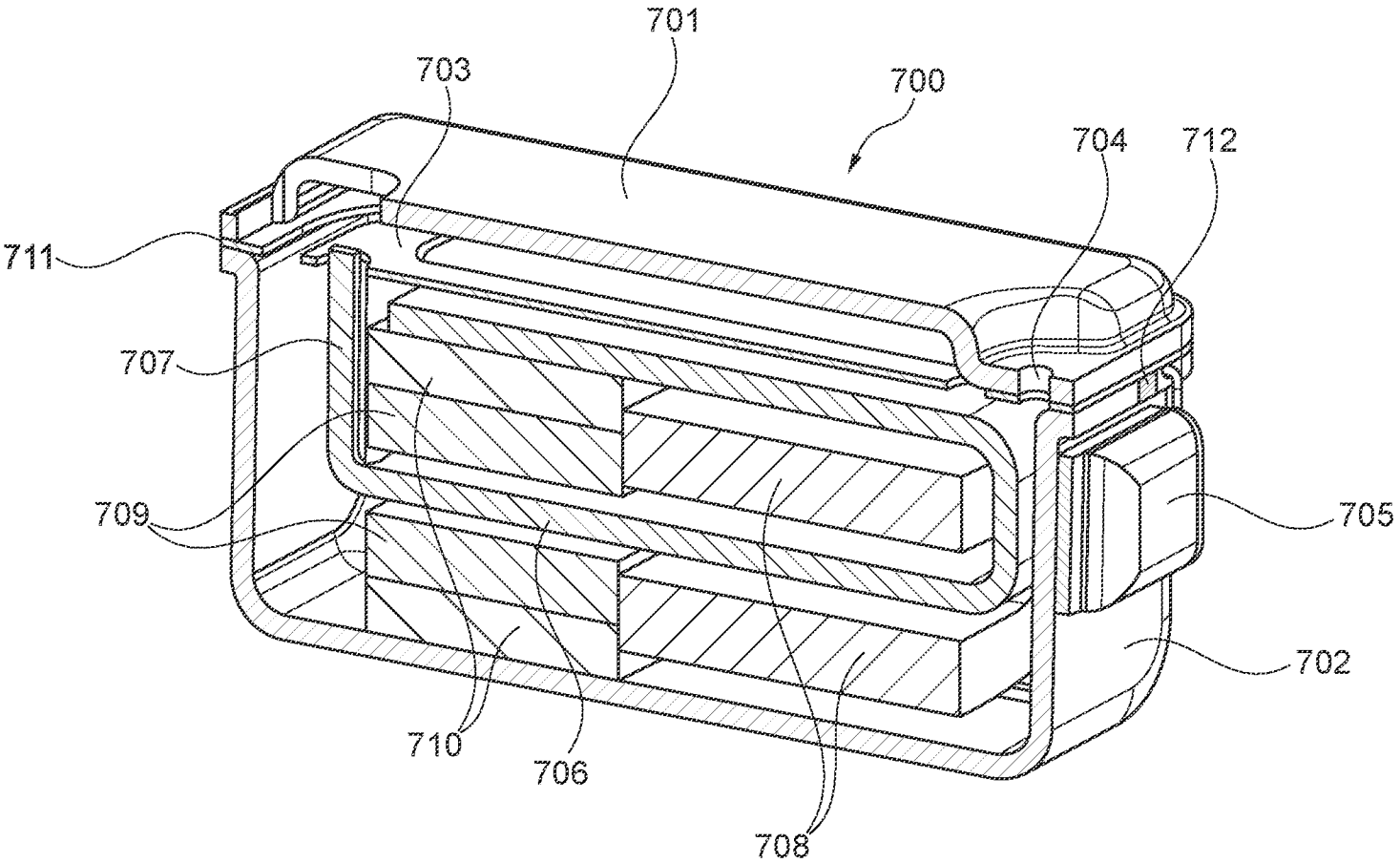
FIG. 7 shows a cross-sectional view of a complete receiver.

In order to generate sound the moveable diaphragm may be moved by a drive unit (not shown) which may include a moving armature type drive unit, cf. FIG. 7. The moving armature type drive unit may comprise a U-shaped armature comprising an integrated drive pin which is mechanically connected to the moveable diaphragm in order to move it in accordance with an applied drive signal.

Figure 2:
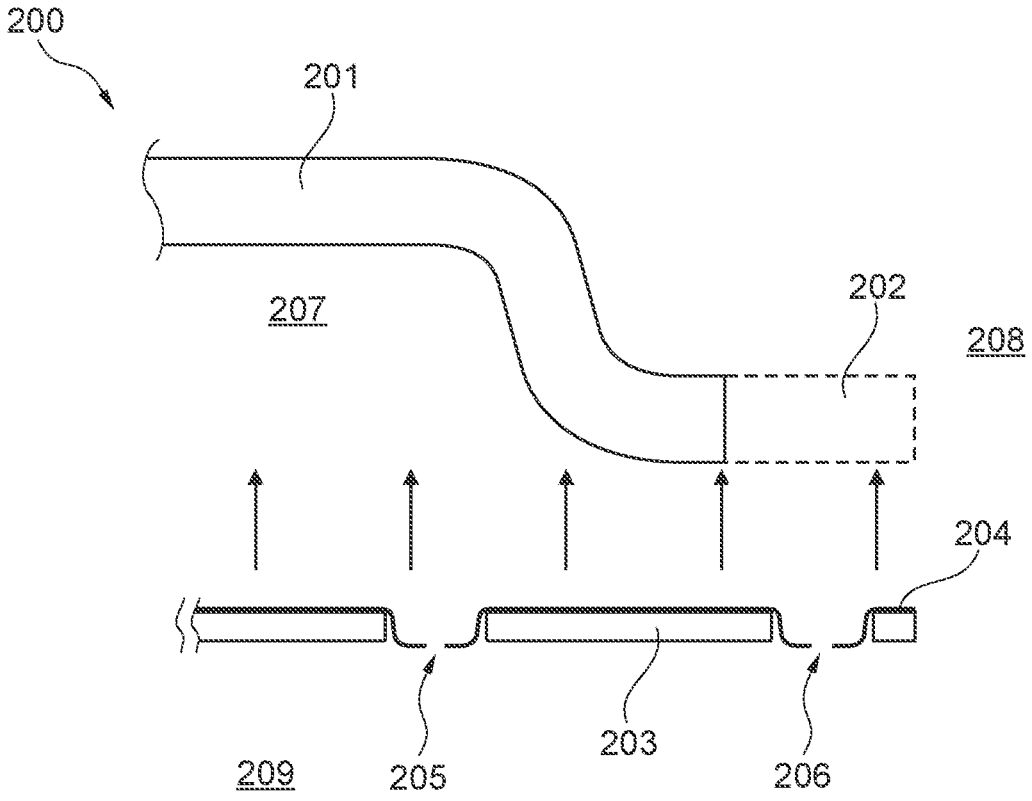
FIG. 2 shows a close-up of implementations of a compensation opening and a venting opening.

Referring now to FIG. 2 an enlarged view of the area 200 around the compensation opening 205 and the venting opening 206 is depicted. As seen in FIG. 2 a foil layer 204 is secured to an upper side of the membrane structure 203. Moreover, the foil layer 204 defines the dimensions of the compensation opening 205 and the venting opening 206 as the openings in the foil layer are smaller than the respective openings in the membrane structure 203. The size of the venting opening 206 is typically between 60 μm and 200 μm whereas the size of the compensation opening 205 is typically between 15 μm and 80. In FIG. 2 the foil layer 204 is secured to the upper side of the membrane structure 203. It should be noted however that the foil layer 204 may alternatively be secured to a lower side of the membrane structure.

The assembly of the membrane structure 203 and the foil layer 204 is adapted to be secured to the cover part 201 which may be extended as indicated by the dotted portion 202. When assembled (as indicated by the arrows) the membrane structure 203 and the foil layer 204 separate the front volume 207 from the back volume 209 although these volumes are acoustically connected via the compensation opening 205. The back volume 209 is acoustically connected to the exterior 208 of the receiver via the venting opening 206 in order to boost the low-frequency response of the receiver.

Figure 3:
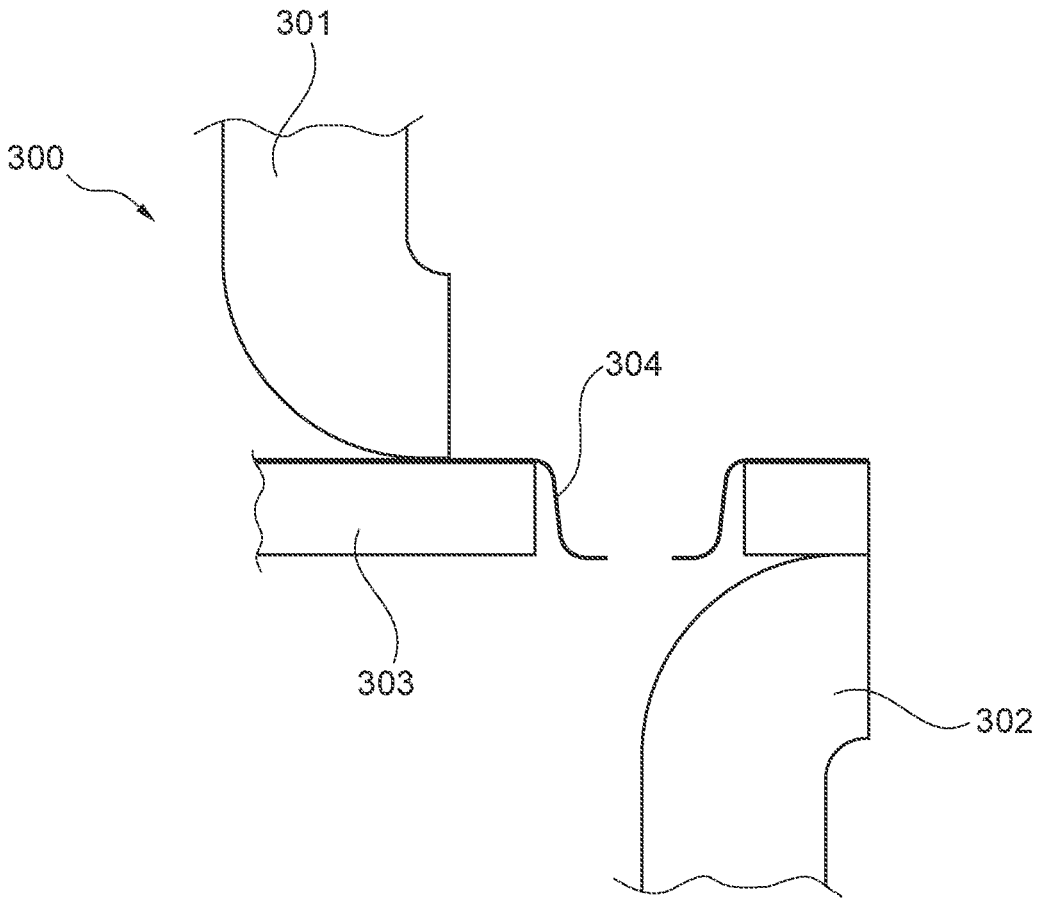
FIG. 3 shows a close-up of an implementation of a venting opening through a membrane.

FIG. 3 shows an even further enlargement of the area 300 around the venting opening. As seen in FIG. 3 the foil layer 304 defines the dimensions of the venting opening in that the opening in the foil layer 304 is smaller than the opening in the membrane structure 303 to which membrane structure 303 a cover part 301 and a can part 302 of a receiver housing are secured. As previously addresses the opening in the foil layer 304 may advantageous be made using a laser. The foil layer 304 may in principle be made of any formable and flexible material, such as a polymer layer including for example polyethylene terephthalate (PET) or polyurethane (PU).

Figure 4:
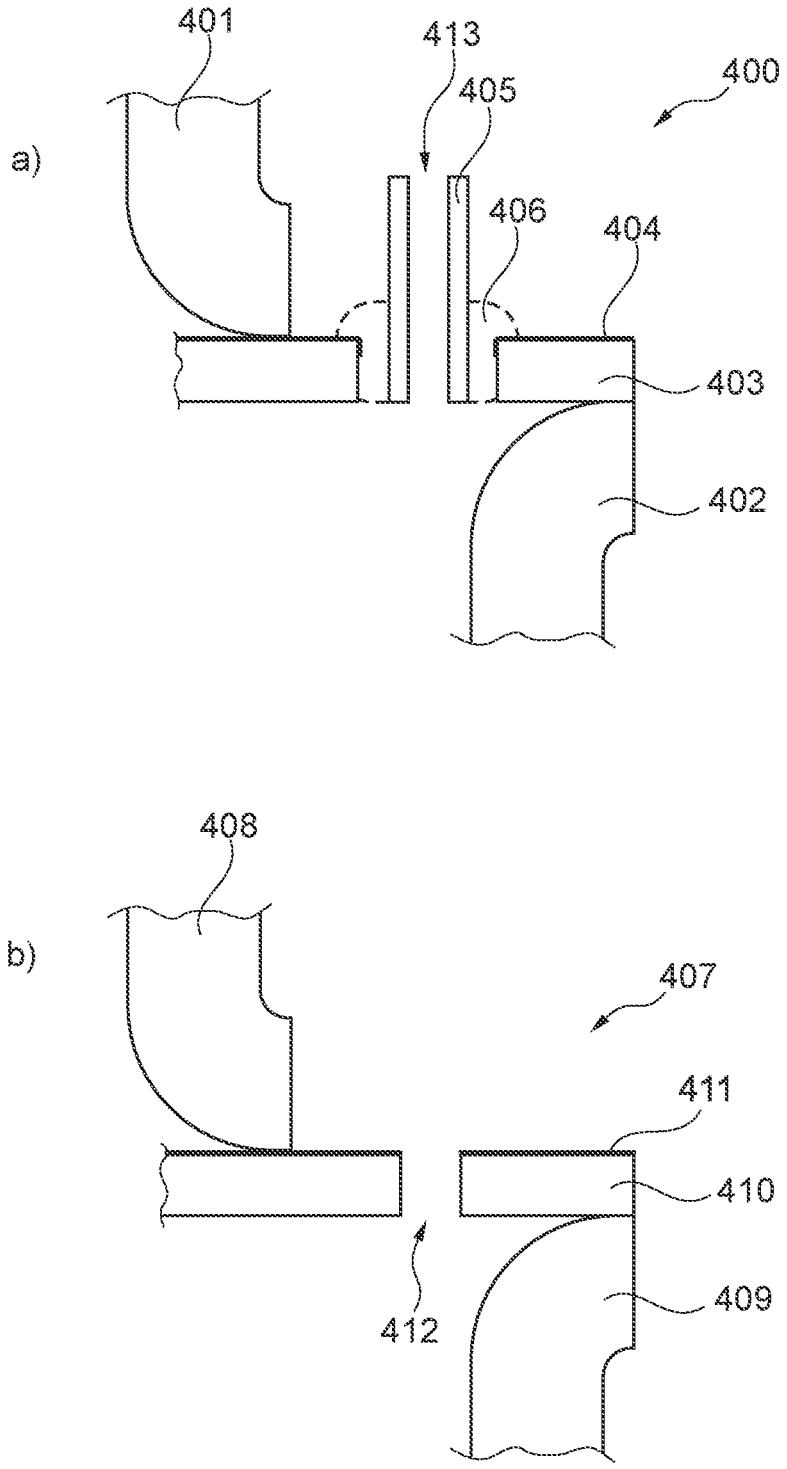
FIG. 4 shows close-ups of further implementations of venting openings through a membrane.

Turning now to FIG. 4 alternative embodiments 400, 407 of the venting openings are depicted. In FIG. 4*a* a tube 405 is secured to the membrane structure 403 using a sealant 406. A foil layer 404 is secured to the upper surface of the membrane structure 403. As previously addressed the foil layer 404 provides one or more seal members across one or more openings between the frame portion and the moveable diaphragm. The tube 405 has an opening 413 that defines the acoustical properties of the venting opening. Similar to the previous embodiments a cover part 401 and a can part 402 are secured to the assembly of the membrane structure 403 and the foil layer 404. In FIG. 4*b* the opening 412 in the membrane structure 410 equals the opening in the foil layer 411, i.e. the size of the two openings are approximate the same. Similar to previous embodiments a cover part 408 and a can part 409 are secured to the assembly of the membrane structure 410 and the foil layer 411. The membrane structure 403, 410 and the foil layer 404, 411 may be manufactured as indicated above.

Figure 5:
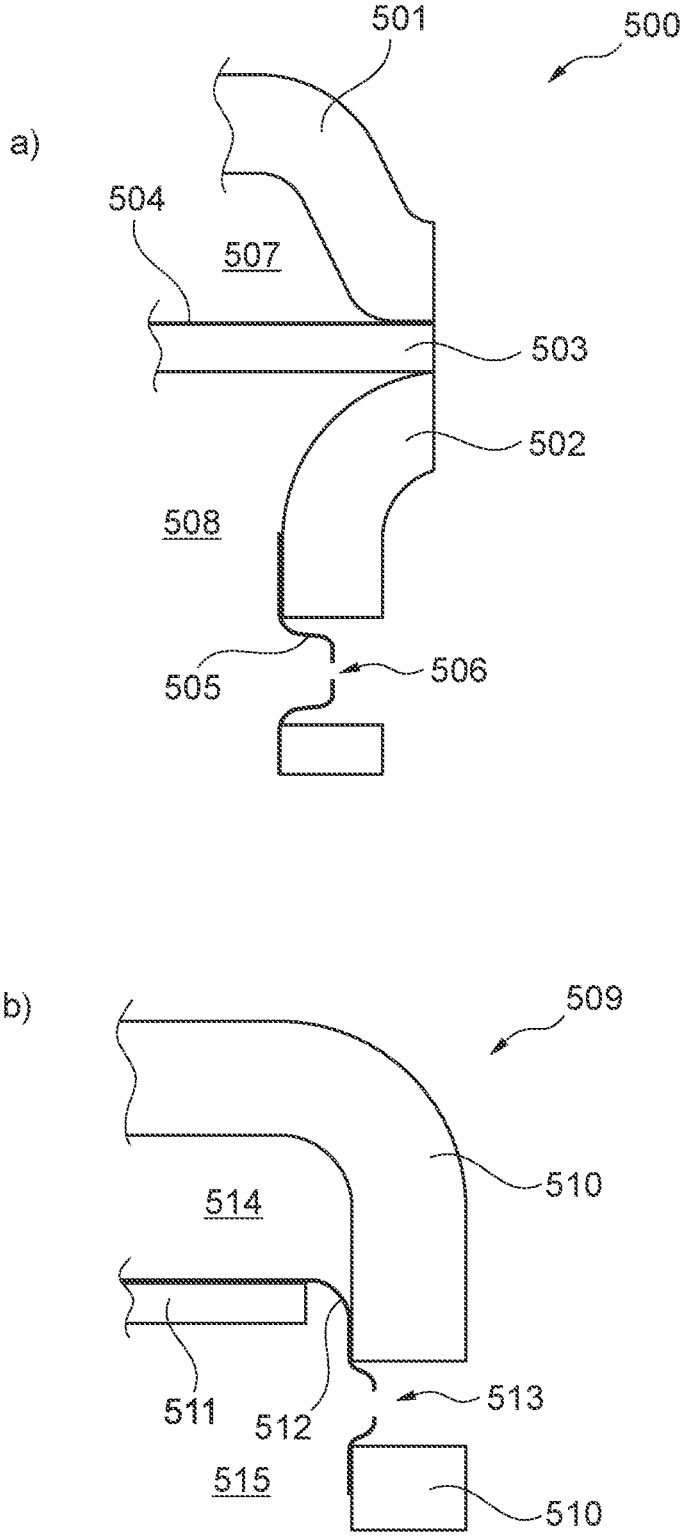
FIG. 5 shows close-ups of implementations of venting openings through a receiver housing.

Referring now to the embodiments 500, 509 shown FIGS. 5*a* and 5*b*, respectively, the venting openings are now positioned in the can part 502 and in the cover part 510, respectively.

FIG. 5*a* shows an enlarged view of a receiver 500 comprising a membrane structure 503 and a foil layer 504 being sandwiched between a cover part 501 and can part 502. The membrane structure 503 and the foil layer 504 secured thereto defines the front volume 507 and the back volume 508 of the receiver. As seen in FIG. 5*a* the can part 502 comprises an opening being at least partly covered by another foil layer 505 having an venting opening 506 therein. The venting opening 506 acoustically connects the back volume 508 to the exterior of the receiver in order to boost the low-frequency response. The foil layer 505 is secured to the can part 502 using appropriate adhesive means. The venting opening 506 in the foil layer 505 may, as previously addressed, advantageous be made using a laser.

In the embodiment shown in FIG. 5*b* the venting opening 513 is provided in the cover part 510 of the receiver 509. As seen in FIG. 5*b* the foil layer 512 secured to the membrane structure 511 is extended so that it may be used to form the acoustical properties of the venting opening 513. The foil layer 512 is secured to both the upper and lower portions of the cover part 510 in order to separate the front volume 514 from the back volume 515. Similar to the previous embodiments the venting opening 513 in the foil layer 512 may advantageous be made using a laser.

Figure 6:
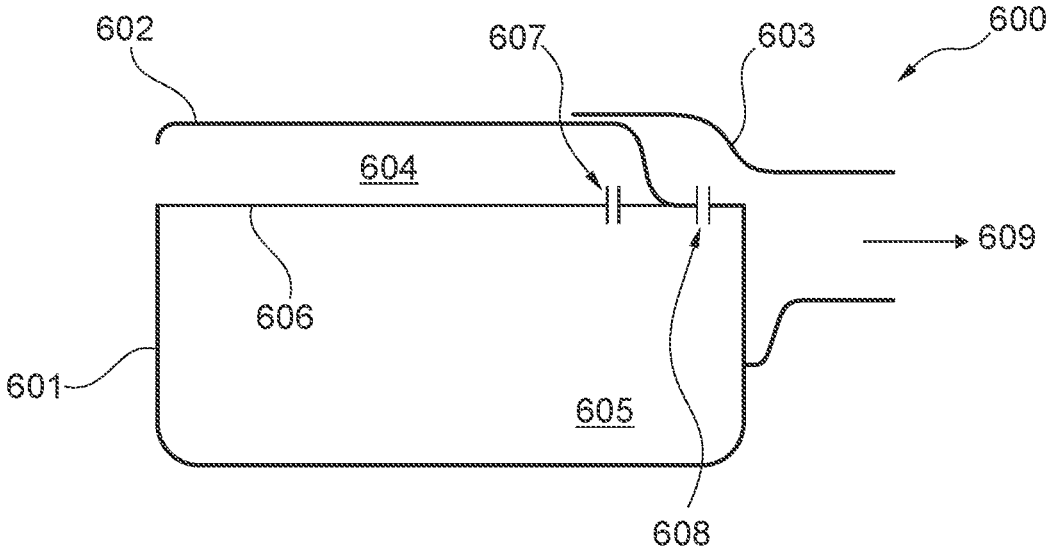
FIG. 6 shows a schematic of a second entire receiver.

In the embodiment 600 depicted in FIG. 6 the front 605 and back 604 volumes have been swapped. Moreover, the venting opening 608 is positioned in the same end as the spout 603 and acts as a variable damping element forming an acoustic low-pass filter in series with the output 609 of the receiver. Similar to the previous embodiments the receiver in FIG. 6 further comprises a cover part 602, a can part 601, a membrane structure 606 and a compensation opening 607. The membrane structure 606 and the foil layer (not shown) secured thereto may be implemented in accordance with the previous embodiments.

FIG. 7 shows a cross-sectional view of a complete receiver 700. Similar to the previous embodiments the receiver shown in FIG. 7 comprises a receiver housing having a cover part 701 and a can part 702. The membrane structure 703 forms a sealing 711 between the cover and can parts 701, 702. A venting opening 704 is provided as a passage through the membrane structure 703, a foil layer (not shown) secured thereto and the cover part 701. Thus, the venting opening 704 forms an acoustical passage between the back volume of the receiver and the exterior of the receiver in order to boost the low-frequency response of the receiver. As depicted in FIG. 7 a drive unit is positioned in the back volume of the receiver. The drive unit depicted in FIG. 7 is a moving armature type drive unit comprising a U-shaped armature 706 having an integrated drive pin 707 being connected to a moveable diaphragm of the membrane structure 703. The moving armature type drive unit further comprises a magnet house 710, permanent magnets 709 and drive coil 708 to which drive coil 708 a drive signal is to be provided via the receiver terminal 705. The receiver terminal 705 may optionally be omitted if the can part 702 (or the cover part 701) of the receiver housing comprises a number of depressions/recesses 712 along its edges in that such depressions/recesses may leave space for wires connected to the drive unit.

In conclusion the present invention addresses a sound generating receiver having an easy implementable venting opening for boosting the low-frequency response of the receiver. A laser processed foil layer may advantageously be applied for tuning the acoustical properties of the venting opening.

The invention claimed is:

1. A receiver assembly comprising a membrane structure comprising a frame portion and a moveable diaphragm, wherein the frame portion and the moveable diaphragm of the membrane structure form an integrated structure without a joint, and wherein one or more openings exist between the frame portion and the moveable diaphragm of the membrane structure;

an assembly housing;

an acoustical venting opening connecting an interior volume of the receiver assembly to an exterior volume outside the assembly housing, the acoustical venting opening forming an acoustical passage at least through the membrane structure; and wherein the acoustical venting opening is formed by a foil layer secured to the membrane structure, the foil layer comprising an acoustical venting opening aligned with the acoustical venting opening in the membrane structure, or wherein the acoustical venting opening comprises a tube forming the acoustical passage through the membrane structure.

2. A receiver assembly according to claim 1, wherein the acoustical venting opening is positioned in the frame portion of the membrane structure.

3. A receiver assembly according to claim 1, wherein the foil layer forms one or more seal members across one or more openings between the frame portion and the moveable diaphragm.

4. A receiver assembly according to claim 1, wherein the dimensions of the acoustical venting opening in the foil layer are smaller than the dimensions of the acoustical venting opening in the membrane structure.

5. A receiver assembly according to claim 1, wherein the thickness of the membrane structure is larger than 20 μm, such as larger than 30 μm, such as larger than 40 μm, and wherein the thickness of the foil layer is smaller than 40 μm, such as smaller than 30 μm, such as smaller than 20 μm, such as smaller than 10 μm, such as smaller than 8 μm, such as smaller than 6 μm, such as smaller than 4 μm.

6. A receiver assembly according to claim 1, further comprising a drive unit for driving the moveable diaphragm of the membrane structure in response to an applied drive signal.

7. A receiver assembly according to claim 6, wherein the drive unit comprises a moving armature type drive unit.

8. A receiver assembly according to claim 7, wherein the moving armature type drive unit comprises a U-shaped armature comprising an integrated drive pin.

9. A receiver assembly according to claim 1, wherein the assembly housing comprises a can part and a cover part, and wherein at least part of the frame portion of the membrane structure forms a seal between the can part and the cover part.

10. A receiver assembly according to claim 9 wherein the can part comprises a number of depressions/recesses along its edges, the depressions/recesses leaving space for wires.

11. A receiver assembly according to claim 9, wherein the cover part comprises a sound outlet opening and an acoustical venting opening forming an acoustical passage through the cover part, the acoustical venting opening being aligned with the acoustical venting opening of the membrane structure.

12. A receiver assembly comprising a membrane structure comprising a frame portion and a moveable diaphragm, wherein the frame portion and the moveable diaphragm of the membrane structure form an integrated structure without a joint, and wherein one or more openings exist between the frame portion and the moveable diaphragm of the membrane structure;

an assembly housing; and an acoustical venting opening connecting an interior volume of the receiver assembly to an exterior volume outside the assembly housing, the acoustical venting opening forming an acoustic passage through the assembly housing and a foil layer secured to the assembly housing, wherein the foil layer comprises an acoustical venting opening aligned with an acoustical venting opening in the assembly housing.

13. A receiver assembly according to claim 12, wherein the foil layer forms part of a foil layer secured to the membrane structure, the foil layer also forming one or more seal members across one or more openings between the frame portion and the moveable diaphragm.

14. A receiver assembly according to claim 12, wherein the assembly housing comprises a can part and a cover part, and wherein at least part of the frame portion of the membrane structure forms a seal between the can part and the cover part.

15. A receiver assembly according to claim 14, wherein the foil layer is secured to the can part so that the acoustical venting opening goes through the can part.

16. A receiver assembly comprising:

a receiver housing comprising a can part and a cover part, the receiver housing defining an inner space, wherein the can part and the cover part are movable relative to each other to define an open configuration and a closed configuration;

an armature extending in a first direction in the inner space; and a moveable diaphragm operationally attached to the armature via a drive pin extending in a second direction, the drive pin and the armature being formed in one part without a joint, and wherein the drive pin and armature are not formed as two separate elements being subsequently assembled.

17. The receiver assembly of claim 1, wherein the frame portion and moveable diaphragm are made from the same material.

* * * * *